United States Patent [19]

Hanlon

[11] Patent Number: 4,938,162

[45] Date of Patent: Jul. 3, 1990

[54] INFLATABLE POWER CATAMARAN

[76] Inventor: Frederick V. Hanlon, 712 Chesapeake Ave., Annapolis, Md. 21403

[21] Appl. No.: 251,256

[22] Filed: Sep. 30, 1988

[51] Int. Cl.[5] ..... B63B 7/08; B63C 9/04

[52] U.S. Cl. ..... 114/61; 114/345

[58] Field of Search ..... 114/345, 354, 352, 39.1, 114/61, 355, 348; 441/40, 37, 44, 45, 130, 132

[56] References Cited

U.S. PATENT DOCUMENTS

| | | | |
|---|---|---|---|
| 3,261,038 | 7/1966 | Klepper | 114/345 |
| 4,449,473 | 5/1984 | McCrory | 114/354 |
| 4,779,555 | 10/1988 | Hong | 114/345 |

FOREIGN PATENT DOCUMENTS

| | | | |
|---|---|---|---|
| 1222813 | 8/1966 | Fed. Rep. of Germany | 114/345 |
| 3507353 | 9/1986 | Fed. Rep. of Germany | 114/345 |
| 1289361 | 9/1972 | United Kingdom | 114/345 |

OTHER PUBLICATIONS

"Zodiac Hurricane Marine" Hurricane Marine Inc., British Colombia, Canada, printed Dec., 1987.
"The Inflatable Boat Buyer's Guide", Intercoastal S. E. Inc., Annapolis, Maryland U.S.A., printed Apr., 1988.
"HBI Hard Bottom Inflatables" HBI Hard Bottom Inflatables, Groton, Connecticut, U.S.A., printed Sep., 1988.
"Zodiac Hurricane Marine" Zodiac Hurricane Marine, Inc., British Colombia, Canada, printed in Canada.
"The Inflatable Boats for Industrial and Commerical Services" Zodiac S.A., Issy Les Moulineaux, France.
"Zodiac '89 Sportsboats" Zodiac International, Issy Les Moulineaux Cedex, France, printed in Italy.
"USARIB TM Is Coming On . . . " USARIB Corporation, Bristol, Rhode Island, and Hard Bottom Inflatables, Groton, Connecticut, U.S.A.
"H.B.I. Brings Color to the World of Inflatables" Hard Bottom Inflatables, Stonington, Connecticut, U.S.A.
"Floating Motomar" Motomar Floating S.r.l., Milano, Italy.
"Zodiac '88" Zodiac International, Issy Les Moulineaux, France, printed in Italy.
"Rigid Hull Inflatable Boats" Zodiac of North America, Stevensville, Maryland, U.S.A.
"Bombard 1988", Bombard, Issy Les Moulineaux, France, printed in Italy.
"Yukon 1988, The Next Generation of Inflatable Boats" Intercoastal S.E. Inc. Annapolis, Maryland, U.S.A.
"Zodiac Rescue, Search & Recovery" Zodiac of North America, Stevensville, Maryland, U.S.A.
"Avon The Unbeatable Inflatables" Avon Inflatables Limited, Dyfed, Great Britain, printed Oct., 1987.
"Achilles 1988 Inflatable Boats" Manufacturer Achilles Corporation, Tokyo, Japan printed in the United States Dec., 1987.

*Primary Examiner*—Joseph F. Peters, Jr.
*Assistant Examiner*—Edwin L. Swinehart
*Attorney, Agent, or Firm*—Foley & Lardner, Schwartz, Jeffery, Schwaab, Mack, Blumenthal & Evans

[57] ABSTRACT

A boat includes a pan of inflatable hull sections having a rigid deck attached thereto. The attachment includes a generally J-shaped connection at a point above the center line on the hull and includes a rigid C-shaped member on the deck cooperating with an inflatable member on the hull.

10 Claims, 5 Drawing Sheets

INFLATABLE POWER CATAMARAN

BACKGROUND OF THE INVENTION

1. Field of the Invention

The invention relates to an inflatable power catamaran, and more particularly to the attachment of the deck to a pair of inflatable pontoons.

2. Related Art

Existing inflatable multi-hull boats include two major components — a pair of inflatable tubes which are normally joined at the bow in a "V" or "U" shape, together with a rigid deck positioned on the tube portions. The traditional boat of this type has its deck attached at or below the center line of the inflatable tubes. The inflatable tubes are obviously buoyant and are pushed in an upwardly direction when riding in the water. The deck portion, being wood and heavier (particularly with people on board), is pushed in a downwardly direction by the weight of the occupants and gravity. This creates a situation wherein the deck and the tubes can separate, i.e., they have a tendency to be pushed apart.

The deck and inflatable tube hulls are attached by laminates of glue and fabric. Alternatively, the rigid portions are attached to the inflatable hulls by a glued-on, sliding track with a nylon rope in the center.

A problem exists in such prior art boats because the hull tubes flex as the boat proceeds through the water, and the inflatable pontoons are constantly being forced to ride on top. Thus, the point where the deck and the pontoons join ride in or are very close to the water surface. At the same time, the rigid body or rigid section of the vessel is also being submerged, but is not as buoyant. Again, this is due to the fact that all inflatable vessels on the market to date have the bottom portion of the vessel's most rigid structure attached to the inflatable pontoons. The rigid portion or portions of the vessel naturally have a tendency to sink, thus creating an effect of a "tug of war" that has a further tendency to tear the bottom of the vessel from the hull tubes, which in turn creates the separation problem discussed above.

Inflatable hull boats presently on the market, because of their design, have a tendency to act as a single hull boat. Therefore, when riding in the water they will not have the operability which exists in a true multi-hull vessel such as a catamaran. Thus, the ride in present inflatable hull vessels is not as smooth as it could be or as what would exist in a true multi-hull inflatable boat.

OBJECTS AND SUMMARY OF THE INVENTION

It is an object of the present invention to provide inflatable hulls and a rigid wing deck which can be easily connected together.

Another object is to provide a point and means of attachment which will yield long-lasting use and will not deteriorate due to the elements.

Another object is to provide a deck having a design which will, cooperating with a plurality of inflatable hulls, give a smooth ride.

A boat includes a pair of inflatable hull sections having a rigid deck attached thereto. The attachment includes a generally J-shaped connection at a point above the center line on the hull and includes a rigid C-shaped member on the deck cooperating with an inflatable member on the hull.

BRIEF DESCRIPTION OF THE DRAWINGS

The above and other objects of the invention will be appreciated from the following description, taken together the accompanying drawings wherein.

DETAILED DESCRIPTION OF THE PREFERRED EMBODIMENTS

Figure 1:
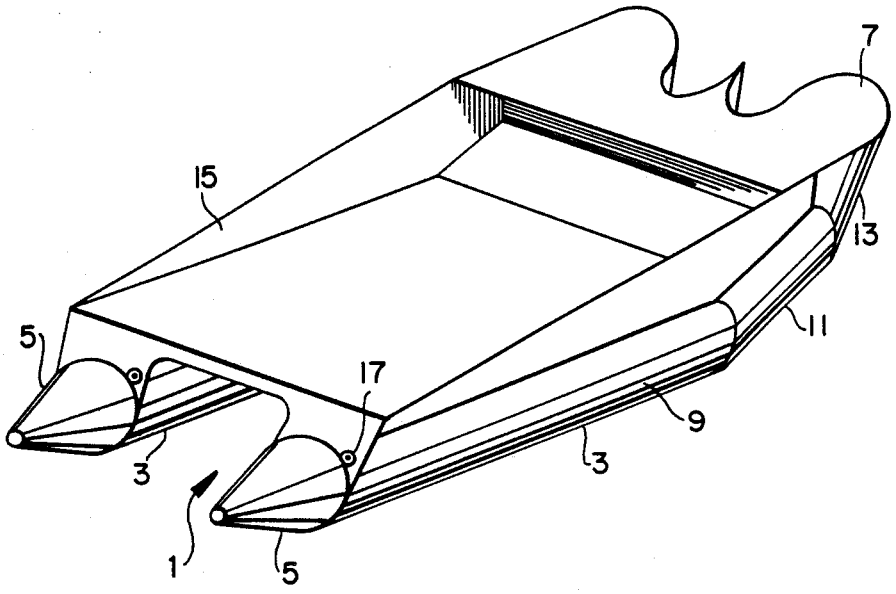
FIG. 1 is a perspective view of a deck mounted on a pair of inflatable hulls.

The boat is seen generally at 1 and includes a pair of inflatable generally J-shaped in profile hull or pontoon sections 3 which are cone-shaped at the stern 5 and substantially oval-shaped at the bow 7. As the hollow pontoon moves from stern 5 toward the bow area, it is a substantially cylindrically-shaped through a horizontal length 9. As the hull moves further toward the bow, it is first angled at 11 and then at 13 as it forms the rake of the bow. The inflatable hull is cut and provided with a bulkhead of wood or fiberglass at 7.

The construction of the inflatable hull 3 is of a conventional Hypalon/Neoprene laminated fabric. The Hypalon is an outside layer formed over a nylon weave which in turn is formed over the Neoprene.

The deck is generally seen at 15. Except as discussed below, the deck is generally conventionally shaped.

Figure 5:
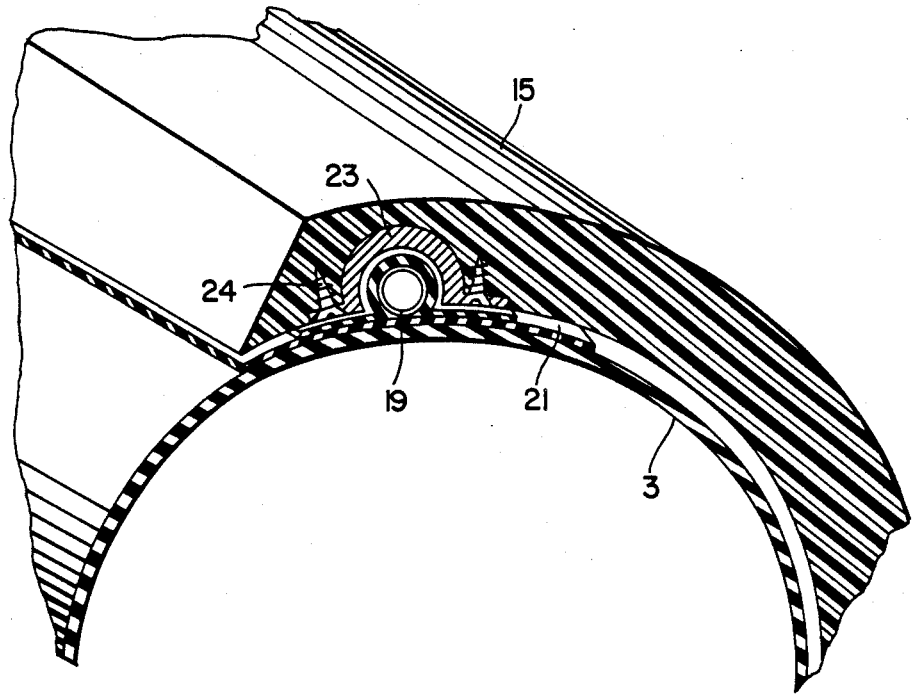
FIG. 5 is a detail of the attachment of the deck to the inflatable hull.

The deck 15 is attached to the J-shaped hulls by an generally J-shaped interlocking connection 17 when viewed from the side. The connection, as seen in FIG. 5, includes an inflatable tube 19 which is of conventional material. The tube 19 is attached to each hull 3 by means of Hypalon/Neoprene fabric 21 of the type used to form the hull 3. The attachment material 21 runs the length of the inflatable hull following the "J" formation 17. Mounted on the deck 15 is a rigid C-shaped member 23 preferably of stainless steel. This tube 23, again follows the "J" shape 17 and is attached to the deck 15 by means of screws 24 rivets or brackets.

The deck is attached to each of the inflatable hulls by positioning the C-shaped tube 23 over a deflated tube 19. The C-shaped tube 23 is preferably slid over the inflatable tube 19 from bow to stern. Since the vessel is going in a forward direction, this is the direction in which the tubes best lock when the boat moves forward, as opposed to creating a situation where the deck would inch forward as the vessel went through the water. When the tube 23 is positioned over the entire length of the vessel, again following the "J" shape 17, the tube 19 is inflated. The tube 19 can be inflated by either gas, air or hydraulic fluid.

Figure 3:
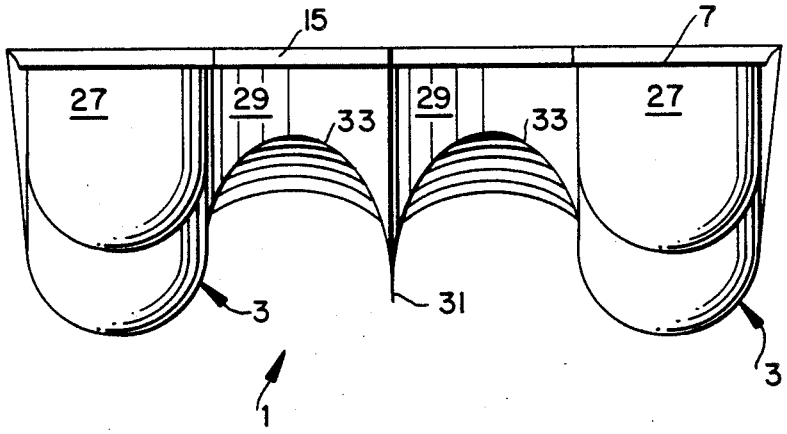
FIG. 3 is a front elevation view thereof.
Figure 4:
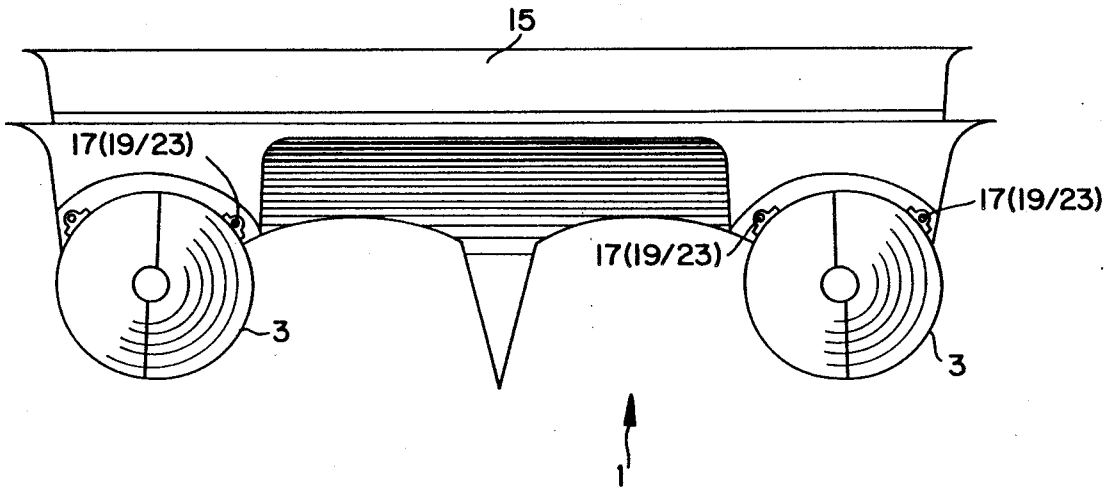
FIG. 4 is a rear elevation view thereof.

The tubes 19/23 are positioned as seen in FIGS. 3 and 4, namely, above the center line of the inflatable hulls 3. In order to provide the interaction between the buoyant hulls and the heavier deck, and to help avoid separation, the connections 17 between tubes 19 and 23 are best located at about 50° from the vertical. Obviously, if connection points 17 are too high toward the vertical, there will not be adequate holding force between the two sides. If connection points 17 fall too low, and particularly below the horizontal center line, they will have a tendency to be in the water too much of the time causing possible deterioration and/or will have a tendency to separate. Also, if the deck is set too low, it reduces the smoothness of the ride because it would detract from the inflatable hull effect and create more of a mono-hull effect.

As discussed above, the connection 17 and hulls three have a generally J-shaped which creates a higher rake than that which exists on most inflatable hull boats. The boat will ride and break the swells better and create a smoother ride. It also creates a certain margin of safety because with the shape as specifically seen at the right in FIG. 2, the vessel rides better than prior inflatables in a rough sea. The design is closer to the traditional catamaran since there is a rigid body attached to two separate hulls. Prior art catamarans have a tendency to go into the swells and dip the bow which can create the pitch-poling effect. The invention has inflatable pontoons, which when going through the swell will remain buoyant, resisting the tendency to dive in nose first to the back of a swell.

Figure 2:
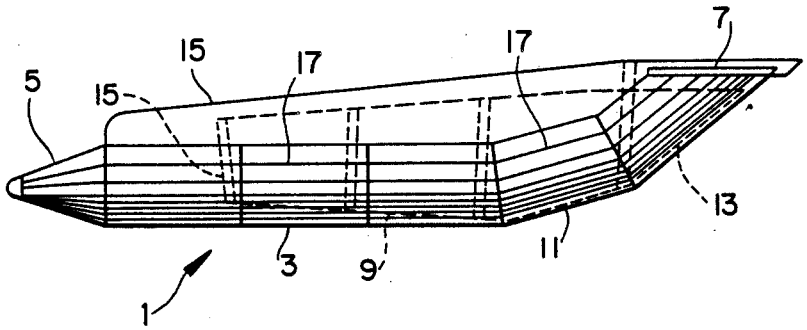
FIG. 2 is a side elevation view of the boat of FIG. 1.

Referring, particularly to FIG. 2, a transom is seen at 25. The transom is recessed in the hull in order to distribute the weight when motors are mounted thereon. Thus, it is possible to mount the engines between the pontoons, as opposed to the ends thereof which is the normal position for a catamaran. This will provide better steerability for the boat, in addition to raising the engines further out of the water than in the traditional catamaran arrangement.

Referring to FIG. 3, the deck 15 has a first portion 27 positioned over the inflatable pontoon and a center portion 29. Between the "J" tube 17, i.e., the connection point, (shown in FIG. 4), and an apex of a center "V" 31, the deck has an arcuate portion 33. The apex 31 is slightly higher than the bottom of the hulls which have a bottom triangular rib-rail thereon. The purpose of the center "V" on the wing deck is to split the mountain of water between the inflatable pontoons to create a twin tunnel effect for twin engines. For smaller or single-engine mountings, the center "V" can be eliminated. It will be appreciated that the deck has the appearance in FIG. 3 of a "crown" creating a crown effect which is part of the tunnel arrangement discussed above.

While several embodiments of the invention have been described, it will be understood that it is capable of further modifications, and this application is intended to cover any variations, uses, or adaptations of the invention, following in general the principles of the invention and including such departures from the present disclosure as to come within knowledge or customary practice in the art to which the invention pertains, and as may be applied to the essential features hereinbefore set forth and falling within the scope of the invention or the limits of the appended claims.

What is claimed is:

1. A boat having a bow and a stern comprising:
(a) at least a pair of separate, individual, inflatable hull sections, said hull sections being J-shaped in profile,
(b) a substantially rigid wing deck forming a superstructure between and above said hull sections, and
(c) means for attaching said deck to each of said hull sections at least essentially only above center lines extending horizontally through each of said hull sections, wherein essentially only said hull sections displace water.

2. A boat as defined in claim 1 wherein said attaching means is located about 50° in each side of a vertical center line.

3. A boat as defined in claim 1 wherein said attaching means includes a pair of interlocking members, one being inflatable.

4. A boat as defined in claim 3 wherein said attaching means includes a generally C-shaped member cooperating with said inflatable member.

5. A boat as defined in claim 4 wherein said C-shaped member is rigid and positioned on said deck and said inflatable member is positioned on said hull sections.

6. A boat as defined in claim 1 wherein said attaching means extends substantially the length of the boat.

7. A boat as defined in claim 3 wherein said inflatable member is attached to said hull sections by a laminated fabric.

8. A boat as defined in claim 1 wherein said deck includes a center "V" portion located between said hull sections.

9. A boat as defined in claim 1 wherein said hull sections have substantially cylindrically shaped horizontal length and an angled rake at the bow.

10. A boat as defined in claim 1 including a transom located between said hull sections and recessed inward from the stern of said hull sections.

* * * * *